US006475073B2

(12) United States Patent
Naoi

(10) Patent No.: US 6,475,073 B2
(45) Date of Patent: Nov. 5, 2002

(54) INNER DIAMETER GRINDING WHEEL AND GRINDING APPARATUS USING THE WHEEL FOR GRINDING A CYLINDRICAL WORKPIECE

(75) Inventor: Yoshihisa Naoi, Saitama (JP)

(73) Assignee: Naoi Seiki Co., Ltd., Saitama (JP)

( * ) Notice: Subject to any disclaimer, the term of this patent is extended or adjusted under 35 U.S.C. 154(b) by 0 days.

(21) Appl. No.: 09/783,291

(22) Filed: Feb. 15, 2001

(65) Prior Publication Data

US 2001/0007812 A1 Jul. 12, 2001

(51) Int. Cl.[7] ..... B24B 9/00
(52) U.S. Cl. ..... 451/180; 451/65; 451/44
(58) Field of Search ..... 451/180, 65, 388, 451/44, 462

(56) References Cited

U.S. PATENT DOCUMENTS 2,745,225 A * 5/1956 Vonada ..... 451/44
2,793,473 A * 5/1957 Hickman ..... 451/65
3,673,739 A * 7/1972 Giardini ..... 451/180
5,316,620 A * 5/1994 Hasegawa et al. ..... 451/28
6,341,999 B1 * 1/2002 Ohmori et al. ..... 451/44

FOREIGN PATENT DOCUMENTS

GB 0006978 * 5/1894 ..... 451/180
JP 405023959 * 2/1993 ..... 451/41

* cited by examiner

*Primary Examiner*—Robert A. Rose
(74) *Attorney, Agent, or Firm*—Browdy and Neimark

(57) ABSTRACT

A grinding apparatus uses an inner diameter grinding wheel (4) to grind a doughnut-shaped workpiece (12), and comprising: an axle support cylinder (5) for support a sleeve-shaped grinding wheel axle (6), mounted on which is the grinding wheel (4) having annular grinding grooves (13) in its inner peripheral surface. The axle (6) is rotatably mounted in the cylinder (5) to vertically pass therethrough and has an upper surface on which the grinding wheel (4) is fixedly mounted; a means for rotatably driving the axle (6); and, a workpiece axle support sleeve (18) provided with a lower workpiece clamp (20) in its upper end, to which the workpiece (12) is attracted by the suction. The sleeve (18) is freely passed through the axle (6). The cylinder (5) and/or the sleeve (18) are capable of moving vertically and horizontally. The apparatus is improved in grinding efficiency to reduce grinding costs.

12 Claims, 4 Drawing Sheets

INNER DIAMETER GRINDING WHEEL AND GRINDING APPARATUS USING THE WHEEL FOR GRINDING A CYLINDRICAL WORKPIECE

BACKGROUND OF THE INVENTION

1. Field of the Invention

The present invention relates to an inner diameter grinding wheel and a grinding apparatus using the grinding wheel to grind a cylindrical workpiece, wherein the workpiece is made of primarily, for example, glass, ceramics, silicon and like materials. The cylindrical workpiece has its inner and/or its outer peripheral surface effectively ground, and further has its edge portions effectively chamfered in the grinding operation thereof.

2. Description of the Related Art

In recent years, the need for cylindrical workpieces, for example such as silicon wafers for fabricating LSIs (i.e., large scale integrated circuits) and like integrated circuits, glass substrates for fabricating hard disks used in computers and the like is increasing. Due to this, the need for effectively grinding an outer and an inner peripheral surface of such cylindrical workpiece at a low cost is also increasing.

In the prior art as shown in FIG. 7, in general, a grinding operation of a cylindrical workpiece 12 of this kind is performed by using an outer diameter grinding wheel 45 of a conventional type which has abrasive grains bonded and fixed to its outer peripheral surface. In such grinding operation performed by using the conventional grinding wheel 45, however, it is not possible to have the grinding wheel 45 brought into contact with the workpiece 12 through a sufficiently large contact area. In other words, the conventional grinding wheel 45 is brought into substantially line-contact with the workpiece 12 during the grinding operation. Due to this, the grinding operation of the conventional grinding wheel 45 takes too much time. Further, in this grinding operation, the workpiece 12 is subjected to concentrated stress at its ground point due to the presence of a radial pressure applied thereto by the grinding wheel 45. When a diametrical feed rate of the grinding wheel 45 is increased in order to enhance the grinding operation in efficiency, the workpiece 12 such as a fragile one made of glass or like fragile material tends to break and produce chipped or broken particles of the workpiece 12. However, when such chipped or broken particles are produced during the grinding operation, the surface finish of the workpiece 12 is seriously impaired. Due to this, it is not possible to increase the diametrical feed rate of the conventional outer diameter grinding wheel 45. For the same reason, it is also not possible for the workpiece 12 to increase the rotational speed of its driven axle.

As described above, the conventional grinding apparatus for grinding the cylindrical workpiece 12 is poor in grinding efficiency, and is therefore not capable of reducing its grinding cost. These are problems inherent in the conventional grinding apparatus.

SUMMARY OF THE INVENTION

Consequently, it is an object of the present invention to solve the above problems by providing an inner diameter grinding wheel and a grinding apparatus using the inner diameter grinding wheel to precisely and effectively grind a cylindrical workpiece at a low cost, even when the workpiece is made of a fragile material such as glass and the like which tends to break and produce chipped or broken particles of the workpiece during the grinding operation.

In accordance with a first aspect of the present invention, the above object of the present invention is accomplished by providing:

An inner diameter grinding wheel provided with a doughnut-shaped main body having a bore portion, comprising a plurality of annular grinding grooves stacked together in a longitudinal direction of the bore portion of the doughnut-shaped main body to form an inner peripheral surface of the bore portion, wherein each of the annular grinding grooves assumes a trapezoidal shape in cross section, wherein the inner peripheral surface of the bore portion is coated with abrasive grains having been fixed to the inner peripheral surface, the abrasive grains being diamond or other similar hard abrasive material.

Preferably, a part of the inner peripheral surface of the bore portion of the main body is constructed of a plain peripheral surface grinding area, the plain peripheral surface grinding area being combined with the annular grinding grooves to form the inner peripheral surface of the bore portion.

Further, preferably, the annular grinding grooves differ from each other in substance and/or grain size of the abrasive grains.

In accordance with a second aspect of the present invention, the above object of the present invention is accomplished by providing:

A grinding apparatus using an inner diameter grinding wheel to grind a cylindrical workpiece, the apparatus comprising:

a grinding wheel axle support cylinder for supporting a sleeve-shaped grinding wheel axle on which the inner diameter grinding wheel is mounted, the inner diameter grinding wheel being provided with a plurality of annular grinding grooves in its inner peripheral surface, wherein the sleeve-shaped grinding wheel axle is rotatably mounted in the grinding wheel axle support cylinder to vertically pass through the grinding wheel axle support cylinder and is provided with an upper surface on which the inner diameter grinding wheel is fixedly mounted;

a rotatably driving means for rotatably driving the sleeve-shaped grinding wheel axle;

a workpiece axle support sleeve provided with a lower workpiece clamp in its upper end, to which clamp the cylindrical workpiece is attracted by the suction, wherein the workpiece axle support sleeve is freely passed through the sleeve-shaped grinding wheel axle;

the grinding wheel axle support cylinder and/or the workpiece axle support sleeve being capable of moving vertically and horizontally.

Preferably, in the grinding apparatus, the inner diameter grinding wheel is provided with a doughnut-shaped main body having a bore portion, and comprises a plurality of annular grinding grooves stacked together in a longitudinal direction of the bore portion of the doughnut-shaped main body to form an inner peripheral surface of the bore portion, wherein each of the annular grinding grooves assumes a trapezoidal shape in cross section, wherein the inner peripheral surface of the bore is coated with abrasive grains having been fixed to the inner peripheral surface, the abrasive grains being diamond or other similar hard abrasive material.

Further, preferably, in the grinding apparatus, a part of the inner peripheral surface of the bore portion of the main body is constructed of a plain peripheral surface grinding area, the plain peripheral surface grinding area being combined with the annular grinding grooves to form the inner peripheral surface of the bore portion.

Still further, preferably, in the grinding apparatus, the annular grinding grooves differ from each other in substance and/or grain size of the abrasive grains.

Preferably, the grinding apparatus further comprises an upper workpiece clamp which is coaxially arranged with the lower workpiece clamp to hold the workpiece from above, wherein the lower workpiece clamp and the upper workpiece clamp are integrally rotated.

Further, preferably, the grinding apparatus is provided with the inner peripheral surface grinding wheel, wherein the inner peripheral surface grinding wheel is rotatably supported by an inner peripheral surface grinding wheel axle support cylinder which is vertically and horizontally movable, the inner peripheral surface grinding wheel being advanced to the interior of each of the upper workpiece clamp and the lower workpiece clamp.

Preferably, the grinding apparatus further comprises a reverse rotation means for rotatably driving the workpiece axle support sleeve in a direction opposite to that of the sleeve-shaped grinding wheel axle.

In the present invention having the above construction, since the outer peripheral surface of the workpiece is grounded by utilizing the inner diameter grinding wheel, it is possible to improve the grinding operation of the workpiece in grinding efficiency without subjecting the workpiece to an excessive grinding pressure, and also possible to perform the grinding operation of the workpiece at a low cost. Further, it is also possible for the present invention to prevent the workpiece from being chipped or broken during the grinding operation, which improves the yield of finished workpieces or products. Still further, the grinding operation performed according to the present invention is remarkably excellent in accuracy and surface finish of the workpiece in comparison with the conventional grinding operation in which an outer diameter grinding wheel is used to grind the workpiece.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

The present invention may, however, be embodied in various different forms and should not be construed as limited to the embodiments set forth herein; rather, these embodiments are provided so that this disclosure will be thorough and complete, and will fully convey the scope of the present invention to those skilled in the art.

First Embodiment

Figure 1:
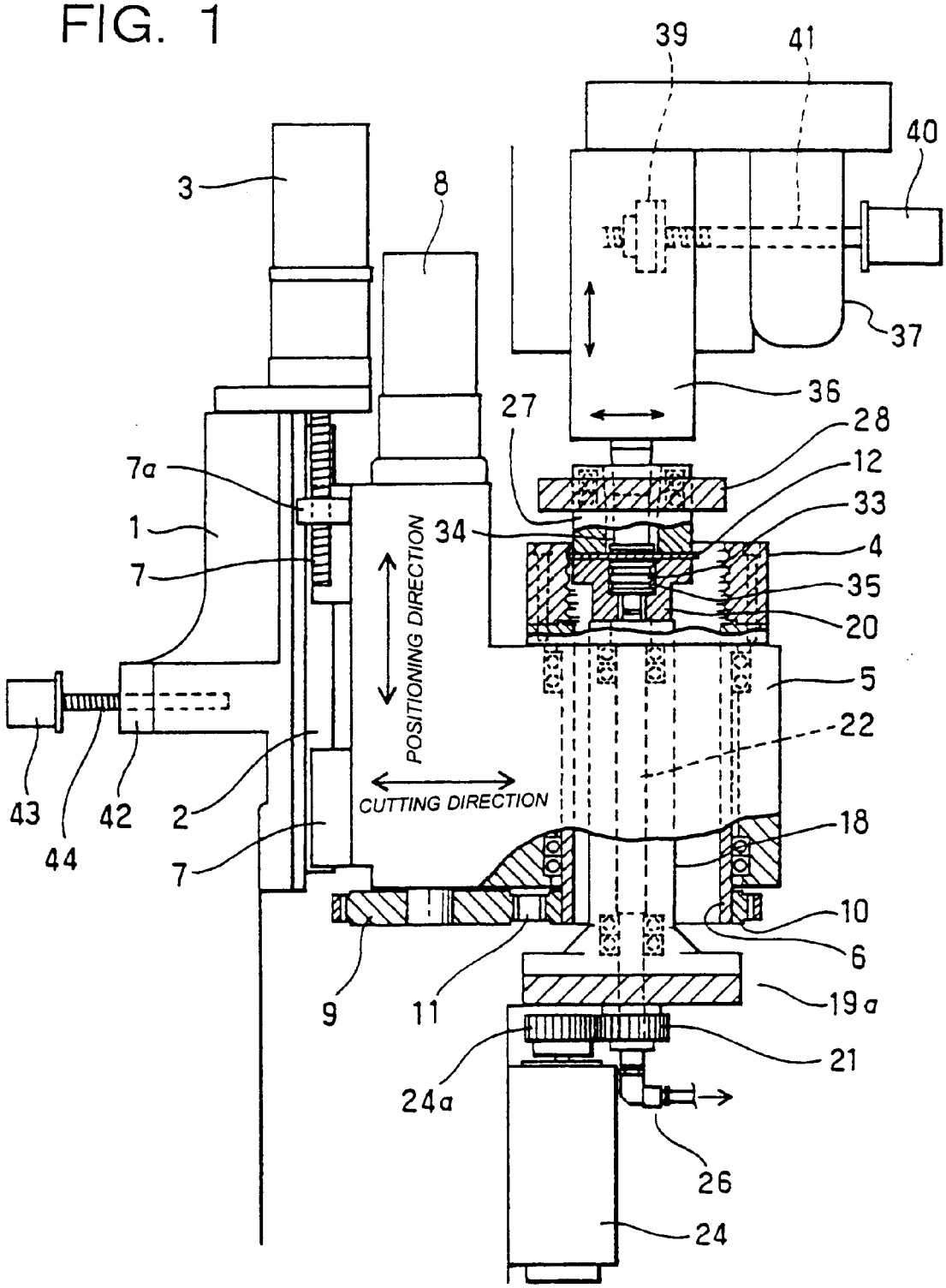
FIG. 1 is a partially broken front view of a grinding apparatus of the present invention.
Figure 2:
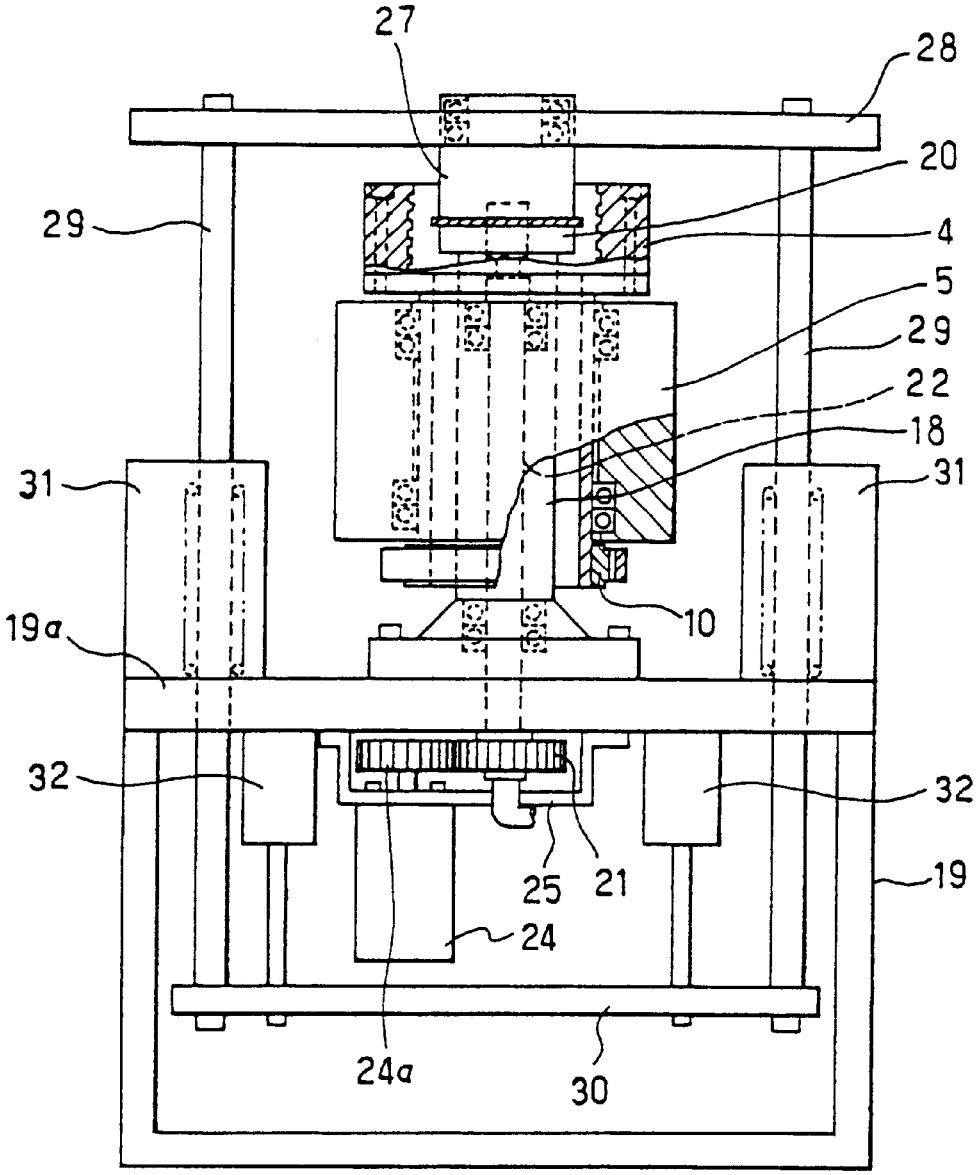
FIG. 2 is a partially broken side view of the grinding apparatus of the present invention shown in FIG. 1.

FIGS. 1 and 2 shows a first embodiment of a grinding apparatus of the present invention in construction. In FIG. 1, the reference numeral 1 denotes a support bracket. Disposed adjacent to a side surface of the support bracket 1 is rail 2 which extends in a vertical direction as viewed in FIG. 1. On the other hand, a servo motor 3 is disposed on an upper end portion of the rail 2 to vertically position an inner diameter grinding wheel 4 (described later) of the present invention with respect to the rail 2. Further, in FIGS. 1 and 2, the reference numeral 5 denotes an axle support sleeve for rotatably support a sleeve-shaped grinding wheel axle 6 of the grinding wheel 4. Disposed beside a side surface of the axle support sleeve 5 is one or a plurality of linear motion ball screw and nut assemblies (hereinafter referred to as "LM ball assemblies") 7. A ball screw nut 7*a* of the LM ball assembly 7 is fixedly mounted on the side surface of the axle support sleeve 5. In operation, when the servo motor 3 is energized, a ball screw nut 7*a* of the LM ball assembly 7 is vertically driven to move up and down along the length of the rail 2, because the ball screw nut 7*a* is meshed with a ball screw fixedly mounted on a rotary shaft of the servo motor 3. Consequently, when the servo motor 3 is energized, the axle support sleeve 5 fixed to the ball screw nut 7*a* of the LM ball assembly 7 is moved up and down so that the vertical positioning operation of the inner diameter grinding wheel 4 in its positioning direction (as viewed in FIG. 1) is performed.

In the drawings, 8 denotes a grinding wheel drive motor for rotatably driving the inner diameter grinding wheel 4. The grinding wheel drive motor 8 is fixedly mounted on an upper surface of the axle support sleeve 5. As shown in FIG. 1, a drive pulley 9 is fixedly mounted on a lower end portion of a rotary shaft of the grinding wheel drive motor 8, which lower end portion extends downward from a lower surface of the axle support sleeve 5. On the other hand, a follower pulley 10 is fixedly mounted on a lower end portion of the sleeve-shaped grinding wheel axle 6 and connected with the drive pulley 9 through a power transmission belt 11 which runs round these pulleys 9, 10. As a result, when the grinding wheel drive motor 8 is energized, the inner diameter grinding wheel 4 fixedly mounted on an upper surface of the grinding wheel axle 6 is rotatably driven by the motor 8.

Figure 3:
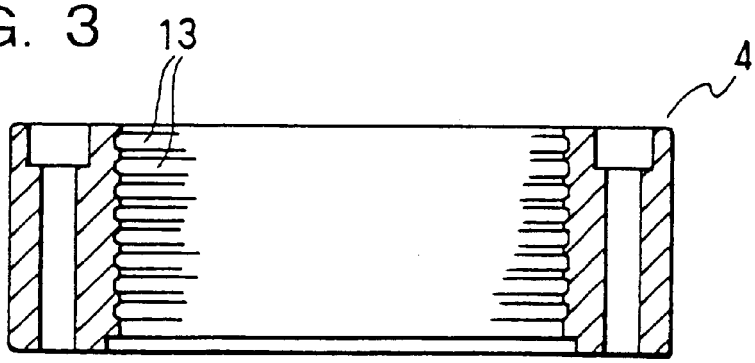
FIG. 3 is a longitudinal sectional view of a first embodiment of an inner diameter grinding wheel of the present invention used in the grinding apparatus shown in FIG. 1, illustrating the configuration of an embodiment of the grinding wheel.
Figure 4A:
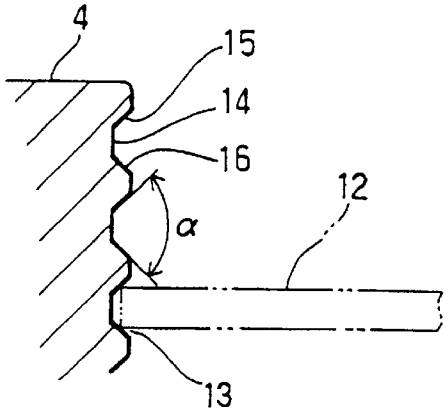
FIG. 4*a* is an enlarged longitudinal sectional view of the inner diameter grinding wheel of the present invention shown in FIG. 3, illustrating a plurality of annular inner grinding grooves of the grinding wheel.
Figure 4B:
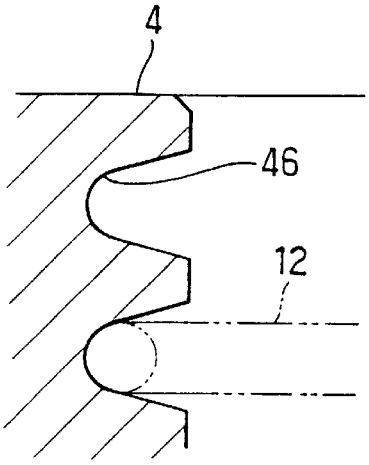
FIG. 4*b* is an enlarged longitudinal sectional view of a second embodiment of the inner diameter grinding wheel of the present invention, illustrating the configuration of each of annular inner grinding grooves of the second embodiment.
Figure 6:
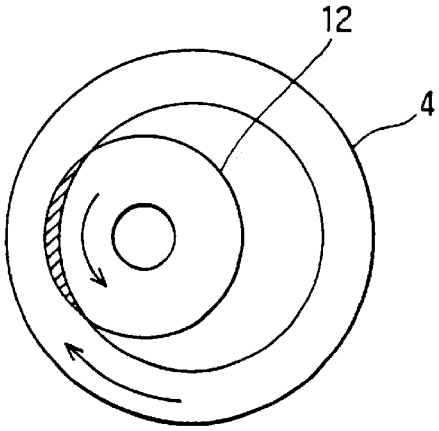
FIG. 6 is a view illustrating a grinding operation performed by using the inner diameter grinding wheel of the present invention.
Figure 7:
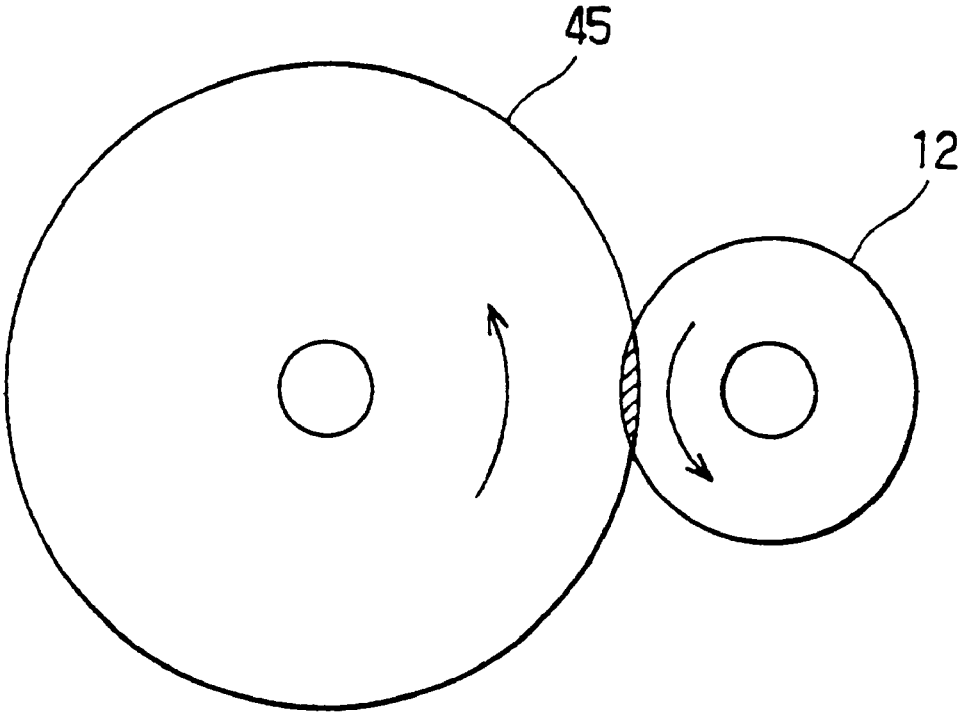
FIG. 7 is a view illustrating a grinding operation performed by using an outer diameter grinding wheel of a conventional type.

In contrast with a conventional outer diameter grinding wheel 45 (shown in FIG. 7) in which abrasive gains are bonded and fixed to an outer peripheral surface of the outer diameter grinding wheel 45, the inner diameter grinding wheel 4 of the present invention is provided with a doughnut-shaped main body having a bore portion. This bore portion has abrasive grains such as diamond particles and the like bonded and fixed to its inner peripheral surface through an electroplating process or by using a suitable bonding agent. The inner diameter grinding wheel 4 may be embodied in various forms. In general, the inner diameter grinding wheel 4 is provided with a plain peripheral surface and the abrasive grains are bonded and fixed to the entire area of such plain peripheral surface. In the grinding apparatus of the present invention using the inner diameter grinding wheel 4, its workpiece 12 such as a hard disk made of glass, a silicon wafer or the like is thin in thickness as shown in dotted lines in FIGS. 4*a* and 4*b*. As is clear from FIG. 3, the inner diameter grinding wheel 4 used in the grinding apparatus of the present invention is provided with a plurality of annular grinding grooves 13 in an inner peripheral surface of its bore portion. These annular grinding grooves 13 are stacked together in a longitudinal direction of the bore portion of the inner diameter grinding wheel 4, and capable of simultaneously grinding both an outer peripheral surface and an axial surface of the workpiece 12. As is clear from FIGS. 4*a* and 4*b*, each of the annular grinding grooves 13 may assume a suitable shape such as a trapezoidal shape, a parabolic shape or any other shape in cross section. As shown in FIG. 4*a*, each of the annular grinding grooves 13 comprises: a groove bottom portion 14 for grinding the outer peripheral surface of the workpiece 12; and, a pair of oblique surface portions 15, 16 for chamfering opposite edge portions of the workpiece 12 in cross section, wherein the oblique surface portions 15, 16 are disposed so as to sandwich the groove bottom portion 14 therebetween. As is clear from FIG. 4*a*, a chamfering angle of the workpiece 12 is determined by an angle "$\alpha$" formed between the opposite oblique surfaces 15, 16. Incidentally, the outer peripheral surface of the workpiece 12 may be curved in cross section. In this case, as shown in FIG. 4*b*, an annular grinding groove 46 formed in the inner peripheral surface of the inner diameter grinding wheel 4 is formed into a parabolic shape in cross section. In the inner diameter grinding wheel 4 provided with such annular grinding groove 46, the workpiece 12 (shown in dotted lines in FIG. 4*b*) is substantially brought into area contact with the grinding wheel 4, so that an area grinding operation of the workpiece 12 is performed by the inner diameter grinding wheel 4, as shown in FIG. 4*b*. Due to such area grinding operation, as shown in FIG. 6, a grinding load applied to the workpiece 12 is evenly distributed over the entire cutting area of the workpiece 12, which prevents the workpiece 12 from being chipped or broken during the grinding operation.

More specifically, as a result of a provisional calculation, in the case where the workpiece 12 is ground by the conventional outer diameter grinding wheel 45, a length of contact area between the workpiece 12 having a diameter of 65 and the conventional outer grinding wheel 45 (shown in FIG. 7) having a diameter of 160 mm is 10.307 mm when each of opposite corner edge portions of the workpiece 12 is chamfered by a depth of 0.6 mm during a grinding operation of the conventional outer diameter grinding wheel 45. Under such circumstances, the workpiece 12 is subjected to a plunge grinding operation to produce a ground part of the workpiece 12, the amount of which ground part reaches 3.9116 $mm^2$. On the other hand, in the case where the workpiece 12 of the same size is ground by the inner diameter grinding wheel 4 having an inner diameter of 105 mm, a length of contact area between the workpiece 12 and the inner diameter grinding wheel 4 is 19.919 mm. At this time, the amount of the ground part of the workpiece 12 reaches 7.6385 $mm^2$. Consequently, in this latter case (i.e., in the present invention), each of the length of contact area and the amount of the ground part of the workpiece 12 is approximately two times as much as that of the former (i.e., conventional) case. Further, when the workpiece 12 of the same size is ground by the inner diameter grinding wheel 4 having an inner diameter of 72 mm, a length of contact area between the workpiece 12 and the inner diameter grinding wheel 4 is 40.031 mm. On the other hand, the amount of the ground part of the workpiece 12 reaches 15.3159 $mm^2$. Consequently, in this case, each of the length of contact area and the amount of the ground part of the workpiece 12 is approximately four times as much as that of the conventional case.

As described above, as for each of the length of contact area and the amount of the ground part of the workpiece 12, there is a remarkable difference between the conventional outer diameter grinding wheel 45 and the inner diameter grinding wheel 4 of the present invention. In the case of the inner diameter grinding wheel 4, a so-called "area grinding" operation is performed so that the grinding load applied to the workpiece 12 is evenly distributed over the entire cutting area of the workpiece 12. Due to this, even when the workpiece 12 is made of a fragile material such as glass and the like, there is substantially no fear that the workpiece 12 is chipped or broken during the grinding operation performed by the inner diameter grinding wheel 4. Further, in the inner diameter grinding wheel 4, since the contact area between the workpiece 12 and the inner diameter grinding wheel 4 is relatively large, there is substantially no fear that vibration of the grinding wheel 4 affects in quality the finished outer peripheral surface of the workpiece 12. Further, in the grinding operation performed by the inner diameter grinding wheel 4, there is substantially no concentrated load applied to the workpiece 12. Consequently, it is possible for the inner diameter grinding wheel 4 to increase its diametrical feed rate, which remarkably enhances its grinding operation in efficiency. This is one of advantages inherent in the inner diameter grinding wheel 4 of the present invention.

Figure 5:
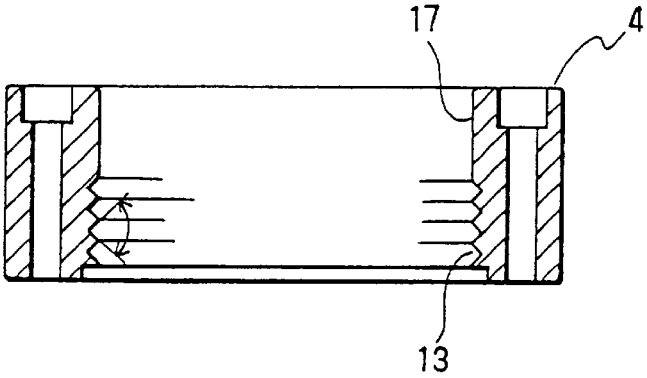
FIG. 5 is a longitudinal sectional view of a third embodiment of the inner diameter grinding wheel of the present invention used in the grinding apparatus shown in FIG. 1, illustrating the configuration of the third embodiment of the inner diameter grinding wheel.

FIG. 5 shows a modification of the inner diameter grinding wheel 4. This modified grinding wheel 4 comprises: a lower half portion in which a plurality of the annular grinding grooves 13 are stacked together in a longitudinal direction of the bore portion of the doughnut-shaped main body to form a lower half of the inner peripheral surface of the bore portion, as is in the case of the first embodiment described above; and, an upper half portion constructed of a plain inner peripheral surface 17.

Incidentally, in each of the first embodiment and the modification of the inner diameter grinding wheel 4, it is possible for its user to use the inner diameter grinding wheel 4 as a rough and/or a finish grinding wheel by changing the abrasive grains in material and/or in grain size in each of the annular grinding grooves 13 of the inner diameter grinding wheel 4.

As shown in FIG. 1, a workpiece axle support sleeve 18 is freely passed through the sleeve-shaped grinding wheel axle 6 in a condition in which an outer peripheral surface of the workpiece axle support sleeve 18 is sufficiently spaced apart from an inner peripheral surface of the grinding wheel axle 6. As shown in FIG. 2, the workpiece axle support sleeve 18 is fixedly mounted on a horizontal plate member 19*a* of a box unit 19. Rotatably mounted in the workpiece axle support sleeve 18 is a workpiece axle 22 which has its upper end portion fixed to a lower workpiece clamp 20 and its lower end portion fixed to a follower gear 21.

In FIG. 2, the reference numeral 24 denotes a worpiece drive motor which is fixedly mounted on a lower surface of the horizontal plate member 19*a* through a bracket 25 to rotatably drive the workpiece 12. The workpiece drive motor 24 is provided with a rotary shaft on which a drive gear 24*a* is fixedly mounted and meshed with the follower gear 21. Consequently, when the workpiece drive motor 24 is energized, the workpiece axle 22 is rotatably driven through the drive gear 24*a* and the follower gear 21 meshed with the drive gear 24*a*, so that the workpiece 12 having been attracted to the lower workpiece clamp 20 by the suction is rotatably driven by the workpiece drive motor 24.

Although there is not shown in the drawings, an air bleeder passage is formed inside the workpiece axle 22 and communicates with an air bleeder hole of the lower workpiece clamp 20. The thus formed air bleeder passage of the workpiece axle 22 has it lower end portion hermetically connected with a reduced-pressure pipe through a rotary joint 26, as shown in FIG. 1. Consequently, the workpiece 12 is attracted to the lower workpiece clamp 20 by the suction derived from a reduced pressure generated in all the reduced-pressure pipe, the rotary joint 26, the air bleeder passage and the air bleeder hole.

When the workpiece 12 has a large diameter, it is possible to attract the workpiece 12 to the lower workpiece clamp 20 through a large suction area. This enables the lower workpiece clamp 20 to firmly attract the workpiece 12 thereto by the suction. On the other hand, when the workpiece 12 has a small diameter, there is provided an upper workpiece clamp 27 for holding the workpiece 12 from above in a manner such that the workpiece 12 is firmly griped between the upper workpiece clamp 27 and the lower workpiece clamp 20.

As shown in FIGS. 1 and 2, the upper workpiece clamp 27 is pivotally mounted on a clamp support plate 28 which is vertically movable. The clamp support plate 28 has each of its opposite end portions fixedly mounted on an upper end portion of each of a pair of guide shafts 29, as shown in FIG. 2. On the other hand, a lower end portion of each of the guide shafts 29 is fixedly mounted on each of opposite end portions of a connecting plate 30. As is clear from FIG. 2, Each of the guide shafts 29 is slidably mounted in each of a pair of ball bush guides 31 so as to be slidably supported by the ball bush guide 31. The ball bush guide 31 is fixedly mounted on each of opposite end portions of the horizontal plate member 19*a* in a manner such that the ball bush guide 31 extends upward from an upper surface of the horizontal plate member 19*a,* as viewed in FIG. 2.

In FIG. 2, the reference numeral 32 denotes a lift cylinder. In general, one or two lift cylinders 32 is or are fixedly mounted on a rear surface of the horizontal plate member 19*a*. The lift cylinder 32 has a free end portion of its rod member fixedly connected with the connecting plate 30. Consequently, when the lift cylinder 32 is actuated to move its rod member, the motion of this rod member is transmitted to the upper workpiece clamp 27 through the connecting plate 30, the guide shafts 29 and the clamp support plate 28, so that the upper workpiece clamp 27 is moved up and down.

On the other hand, as shown in FIG. 1, fixedly mounted in the support bracket 1 is a ball screw nut 42 which is threadably engaged with a ball screw 44. This ball screw 44 is rotatably driven by a servo motor 43 which is fixedly mounted on a first column member (not shown). Consequently, when the servo motor 43 is energized, the individual components mounted on the support bracket 1 are horizontally moved so that a positioning operation of the inner diameter grinding wheel 4 is performed.

Incidentally, in grinding an outer peripheral surface of the cylindrical workpiece 12 such as a silicon wafer and the like, it is possible to hold the support bracket 1 stationarily in a condition in which the workpiece 12 is moved so as to have its outer peripheral surface positioned in the grinding operation.

As described above, the grinding apparatus of the embodiment having the above construction is capable of grinding the outer peripheral surface of the workpiece 12. On the other hand, when the workpiece 12 assumes a doughnut-shaped configuration and has its inner and its outer peripheral surface ground, an additional construction is required as follows: namely, an inner peripheral surface grinding wheel 33 (shown in FIG. 1) for grinding the inner peripheral surface of the doughnut-shaped workpiece 12 is provided so as to be advanced in grinding operation to the interior of a recessed hole 35 of the lower workpiece clamp 20 through a grinding wheel passage hole 34 formed in a central area of the upper workpiece clamp 27. In FIG. 1, the reference numeral 36 denotes a grinding wheel axle support sleeve for rotatably supporting a grinding wheel axle of the inner peripheral surface grinding wheel 33. Fixedly mounted on the axle support sleeve 36 is an inner peripheral surface grinding motor 37 for rotatably driving the grinding wheel axle of the inner peripheral surface grinding wheel 33.

Fixedly mounted on the axle support sleeve 36 is a ball screw nut 39 which is threadably engaged with a ball screw 41. The ball screw 41 is rotatably driven by a servo motor 40 which is fixedly mounted on a second column member (not shown). Consequently, when the servo motor 40 is energized, both the axle support sleeve 36 and the inner peripheral surface grinding wheel 33 are horizontally moved through a threadably engagement between the ball screw 41 and the ball screw nut 39, so that the inner peripheral surface grinding wheel 33 is positioned in its cutting direction, as viewed in FIG. 1. Further, by providing an additional servo motor, an additional ball screw and an additional ball screw nut threadably engaged with the additional ball screw all of which are used to vertically move both the axle support sleeve 36 and the inner peripheral surface grinding wheel 33, it is possible to move both the axle support sleeve 36 and the inner peripheral surface grinding wheel 33 in a positioning direction shown in FIG. 1.

Now, the grinding operation of the grinding apparatus having the above construction will be described. Prior to the grinding operation, as shown in FIG. 2, the lower workpiece clamp 20 is still not brought into contact with the inner diameter grinding wheel 4. First, Manually or mechanically the doughnut-shaped workpiece 12 is placed on the lower workiece clamp 20 and then attracted thereto by the suction. After that, the lift cylinder 32 is actuated in a manner such that the upper workpiece clamp 27 is moved downward, whereby the workpiece 12 is held firmly between the upper workpiece clamp 27 and the lower workpiece clamp 20. Then, the grinding operation of the workpiece 12 is performed. At this time, it is possible to grind the inner and the outer peripheral surface of the doughnut-shaped workpiece 12 individually or simultaneously.

In the grinding operation of the inner peripheral surface of the workpiece 12, the workpiece 12 is rotatably driven in a condition in which the inner peripheral surface grinding motor 37 is energized to rotatably drive the inner peripheral surface grinding wheel 33 (shown in FIG. 1) for grinding the inner peripheral surface of the doughnut-shaped workpiece 12. After that, the servo motor 40 is energized to determine the cutting position of the inner peripheral surface grinding wheel 33. A desired one of the annular grinding grooves 13 of the inner peripheral surface grinding wheel 33 is selected by energizing a servo motor (not shown) prior to the grinding operation or when both the workpiece 12 and the inner diameter grinding wheel 4 are rotatably driven.

When the outer peripheral surface of the doughnut-shaped workpiece 12 is ground, the workpiece 12 is rotatably driven in a condition in which the grinding wheel drive motor 8 is energized to rotatably drive the inner diameter grinding wheel 4. After that, the servo motor 43 is energized so that the cutting position of the inner diameter grinding wheel 4 is determined. Further, prior to the grinding operation or when both the workpiece 12 and the inner diameter grinding wheel 4 are rotatably driven, the servo motor 3 is energized to move the axle support sleeve 5 up and down so that a desired one of the annular grinding grooves 13 of the inner diameter grinding wheel 4 is selected to perform the grinding operation.

Incidentally, in grinding the inner and the outer peripheral surface of the doughnut-shaped workpiece 12, it is possible to improve such inner and outer grinding operations in grinding efficiency by simultaneously positioning both the inner and the outer cutting point of the workpiece 12.

Although the above description relates to the cylindrical workpiece 12 such as one assuming a doughnut-like shape or a disk-like shape, it is a matter of course that the grinding apparatus of the present invention is capable of grinding the workpiece 12 assuming any other shape, for example such as a cylindrical column shape, a square shape or the like.

Further, in the above description, as shown in FIG. 1, though the workpiece axle 22 is vertically arranged, it is also possible to horizontally arrange the workpiece axle 22 in the grinding apparatus of the present invention.

What is claimed is:

1. A grinding apparatus using an inner diameter grinding wheel (4) to grind a cylindrical workpiece (12), the apparatus comprising:

a grinding wheel axle support cylinder (5) for supporting a sleeve-shaped grinding wheel axle (6) on which said inner diameter grinding wheel (4) is mounted, said inner diameter grinding wheel (4) being provided with a plurality of annular grinding grooves (13) in its inner peripheral surface, wherein said sleeve-shaped grinding wheel axle (6) is rotatably mounted in said grinding wheel axle support cylinder (5) and is provided with an upper surface on which said inner diameter grinding wheel (4) is fixedly mounted;

a rotatably driving means for rotatably driving said sleeve-shaped grinding wheel axle (6);

a workpiece axle support sleeve (18) provided with a lower workpiece clamp (20) in its upper end, to which clamp (20) said cylindrical workpiece 912) is attracted by suction, wherein said workpiece axle support sleeve (18) is freely passed through said sleeve-shaped grinding wheel axle (6);

said grinding wheel axle support cylinder (5) or said workpiece axle support sleeve (18) being capable of moving vertically and horizontally.

2. The grinding apparatus as set forth in claim 1, wherein said inner diameter grinding wheel (4) provided with a doughnut-shaped main body having a bore portion, comprising a plurality of annular grinding grooves (13) stacked together in a longitudinal direction of said bore portion of said doughnut-shaped main body to form an inner peripheral surface of said bore portion, wherein each of said annular grinding grooves (13) assumes a trapezoidal shape in cross section, wherein said inner peripheral surface of said bore is coated with abrasive grains having been fixed to said inner peripheral surface, said abrasive grains being a hard abrasive material.

3. The grinding apparatus as set forth in claim 2, wherein a part of said inner peripheral surface of said bore portion of said main body is constructed of a plain peripheral surface grinding area (17), said plain peripheral surface grinding area (17) being combined with said annular grinding grooves (13) to form said inner peripheral surface of said bore portion.

4. The grinding apparatus as set forth in claim 3, wherein said annular grinding grooves (13) differ from each other in substance or grain size of said abrasive grains.

5. The grinding apparatus as set forth in claim 1, wherein the grinding apparatus further comprises an upper workpiece clamp (27) which is coaxially arranged with lower workpiece clamp (20) to hold said workpiece from above, wherein said lower workpiece clamp (20) and said upper workpiece clamp (27) are integrally rotated.

6. The grinding apparatus as set forth in claim 1, wherein the grinding apparatus is provided with an inner peripheral surface grinding wheel (33), wherein said inner peripheral surface grinding wheel (33) is rotatably supported by an inner peripheral surface grinding wheel axle support cylinder which is vertically and horizontally movable, said inner peripheral surface grinding wheel (33) being advanced to the interior of each of said upper workpiece clamp (27) and said lower workpiece clamp (20).

7. The grinding apparatus as set forth in therefor claim 1, wherein the grinding apparatus further comprises a reverse rotation means for rotatably driving said workpiece axle support sleeve (18) in a direction opposite to that of said sleeve-shaped grinding wheel axle (6).

8. The grinding apparatus as set forth in claim 2, wherein the grinding apparatus further comprises a reverse rotation means for rotatably driving said workpiece axle support sleeve (18) in a direction opposite to that of said sleeve-shaped grinding wheel axle (6).

9. The grinding apparatus as set forth in claim 3, wherein the grinding apparatus further comprises a reverse rotation means for rotatably driving said workpiece axle support sleeve (18) in a direction opposite to that of said sleeve-shaped grinding wheel axle (6).

10. The grinding apparatus as set forth in claim 4, wherein the grinding apparatus further comprises a reverse rotation means for rotatably driving said workpiece axle support sleeve (18) in a direction opposite to that of said sleeve-shaped grinding wheel axle (6).

11. The grinding apparatus as set forth in claims 5, wherein the grinding apparatus further comprises a reverse rotation means for rotatably driving said workpiece axle support sleeve (18) in a direction opposite to that of said sleeve-shaped grinding wheel axle (6).

12. The grinding apparatus as set forth in claim 6, wherein the grinding apparatus further comprises a reverse rotation means for rotatably driving said workpiece axle support sleeve (18) in a direction opposite to that of said sleeve-shaped grinding wheel axle (6).

* * * * *